US005855370A

United States Patent [19]

Stoughton, Jr.

[11] Patent Number: 5,855,370

[45] Date of Patent: Jan. 5, 1999

[54] MEMORY ENHANCING GAME

[76] Inventor: George E. Stoughton, Jr., 6636 Silverstream Ave., Las Vegas, Nev. 89107

[21] Appl. No.: 967,413

[22] Filed: Nov. 11, 1997

[51] Int. Cl.[6] ..... A63F 3/00

[52] U.S. Cl. ..... 273/273; 273/292

[58] Field of Search ..... 273/273, 276, 273/288, 291, 292

[56] References Cited

U.S. PATENT DOCUMENTS

| | | | |
|---|---|---|---|
| 3,330,053 | 7/1967 | Hendrix | 273/292 |
| 3,638,947 | 2/1972 | Hardesty | 273/135 AC |
| 3,674,274 | 7/1972 | Schur | 273/135 AC |
| 3,677,548 | 7/1972 | Hincz | 273/273 |
| 3,876,206 | 4/1975 | Moura | 273/273 |
| 4,222,572 | 9/1980 | Baker | 273/306 |
| 4,535,995 | 8/1985 | Warnick | 273/273 |
| 4,838,551 | 6/1989 | Volpert | 273/273 |
| 5,190,296 | 3/1993 | Sainsbury | 273/296 |

*Primary Examiner*—William M. Pierce
*Attorney, Agent, or Firm*—Henderson & Strum

[57] ABSTRACT

A memory enhancing game 10 including a certain number of visually distinguishable assigned game piece members 27" having indicia 28 provided on one face 26 and twice the certain number of blank game piece members 27' wherein all of the game piece members 27 are virtually indistinguishable from one another in the face down orientation, and the steps that govern the playing of the game.

4 Claims, 1 Drawing Sheet

MEMORY ENHANCING GAME

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of games in general, and in particular to a memory enhancing game.

2. Description of Related Art

As can be seen by reference to the following U.S. Pat. Nos. 3,638,947; 3,674,274; 4,535,995; and 5,190,296 the prior art is replete with myriad and diverse games employing game pieces having a plurality of indicia used to improve the player's memory by playing the game.

While all of the aforementioned prior art constructions are more than adequate for the basic purpose and function for which they have been specifically designed, they are uniformly deficient with respect to their failure to provide a new and unique set of game pieces that only differ in their external appearance on only one of the faces of the game piece (if any) and wherein the uniform faces of the various game pieces are visible to all players. Each player in turn will be allowed to reveal the hidden face of a game piece which may or may not bear indicia and if indicia is present on the hidden face, it may not be the indicia sought by an individual player.

As a consequence of the foregoing situation, there has existed a longstanding need for a new and improved type of memory enhancing game wherein the game pieces and the rules of the game place a premium on remembering the location, as well as the presence or lack of indicia on a given game piece and the provision of such a construction is a stated objective of the present invention.

BRIEF SUMMARY OF THE INVENTION

Briefly stated, the memory enhancing game that forms the basis of the present invention comprises a plurality of uniformly configured game pieces wherein each of the game piece members are virtually indistinguishable from one another when they are disposed in a face down orientation.

As will be explained in greater detail further on in the specification, the game piece members are divided into two distinct types with one type being blank on all of the faces and the other type having visually distinguishing indicia provided on one face.

In addition, the blank game piece members outnumber the visually distinctive game piece members two to one. However, when the game begins there will be an equal number of blank game piece members and player assigned game piece members disposed in a face down orientation.

Furthermore, as the game progresses, the total number and position of the face down game pieces will remain the same as each player removes their assigned game piece members and substitutes therefor blank game piece members thereby placing a premium on the remembered location of the undesired game piece members.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
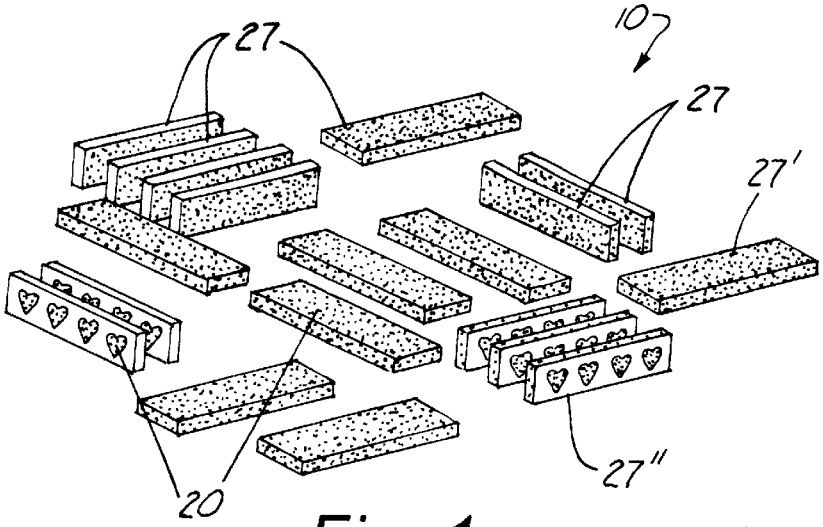
FIG. 1 is a perspective view of the memory enhancing game in progress.

As can be seen by reference to the drawings, and in particularly to FIG. 1, the memory enhancing game that forms the basis of the present invention is designated generally by the reference number 10. The game 10 comprises a plurality of game pieces 20 wherein each game piece 20 has six sides 21, 22, 23, 24, 25, 26 defining an elongated rectangular game piece member 27.

Still referring to FIGS. 2 and 3, it can be seen that each game piece member 27 has at least five sides 21, 22, 23, 24, and 25 which are identical in appearance for reasons that will be explained presently and the width of the elongated narrow side panels 24 and 25 is sufficient to give each of the game piece members 27 a stand alone capability in the vertical orientation as shown in FIG. 1.

Figure 2:
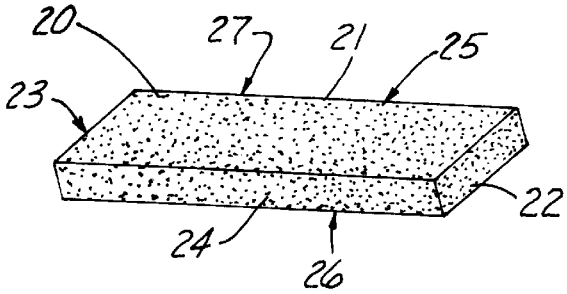
FIG. 2 is a top perspective view of a representative game piece.
Figure 3:
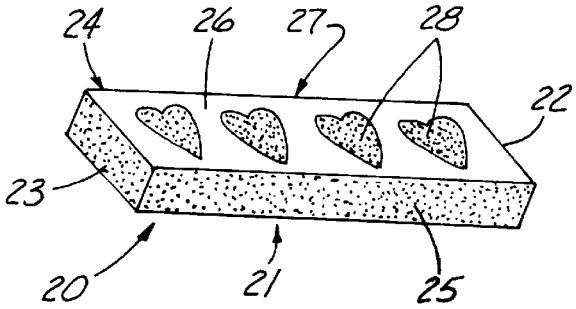
FIG. 3 is a bottom perspective view of a game piece bearing colored indicia on only one face.
Figure 4:
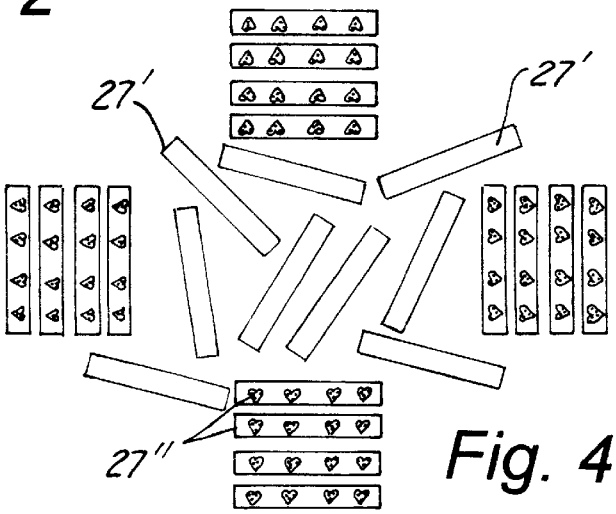
FIG. 4 is a bottom view of the blank and colored indicia bearing game pieces prior to the mixing of the game pieces.

Turning now to FIGS. 2 through 4, it can be seen that a certain number "X" of the game pieces 27 have their bottom or sixth side 26 identical in appearance to the other five sides to create a blank game piece member 27' and a certain number "Y" of the game pieces 27 have their bottom or sixth side 26 provided with distinguishing indicia 28 to create a marked game piece member 27".

It should also be noted at this juncture that the distinguishing indicia 28 may comprise different colors and/or patterns so that each player of the memory enhancing game 10 may be able to readily visually distinguish their assigned game pieces 27" from those of their opponents game pieces 27" and obviously any blank game pieces 27'.

The total number "Z" of game pieces 27 employed in the game 10 will be determined by the number of players "P" multiplied by a whole number "N". Each player will have twice the number of blank game piece members 27' as assigned game pieces 27".

In the preferred embodiment the whole number will be twelve such that each player will have eight blank game piece members 27' and four assigned game piece members 27" wherein each player's assigned game piece members 27" will be distinguishable from the other players assigned game piece members 27" through the use of different colors and/or indicia 28.

The rules for playing the game are rather simple in that each player is given eight blank game piece members 27' and four assigned game piece members 27" to begin the game. Each player will then place four blank game piece members 27' arrayed in a vertical orientation before themselves and the remaining blank game pieces 27' and their individually assigned distinguishable game pieces 27" in a face down orientation and thoroughly mixed up such that the game pieces 20 cannot be distinguished from one another.

A mutually agreeable order of play will be agreed upon among the players and the first player will withdraw a game piece member 27 in such a manner as to uncover the bottom side 26 without that surface 26 being visible to any of the other players.

In the event that the chosen game piece member 27 is a blank game piece 27 or an assigned game piece 27" belonging to one of the other players, the first player will return the chosen game piece 27 to its original location and the next player in the rotation will be allowed to make their own choice.

However, in the event that a player chooses one of their own assigned game pieces 27", they will remove the assigned game piece 27" from play and replace that assigned game piece member 27" from play and replace that assigned game piece member 27" with one of the blank game piece members 27' disposed in front of them. The blank game piece member 27' will occupy the former position of the chose game piece member 27.

The successful player will then make another choice of a game piece member 27 until they choose either a blank game piece member 27' or an assigned game piece member 27" which belongs to another player.

At this juncture, it should be appreciated that a premium is placed on each player remembering not only the position of each of the game piece members 27 that they personally chose that are not one of their own assigned game piece members 27", but also the position of the game piece members 27 that the other players have replaced with blank game piece members 27'.

It should also be noted that the total number of face down game piece members 27 from which to make a choice remains constant throughout the course of the game by virtue of the substitution of the reserved blank game piece members 27' for the individually assigned game piece members 27" that each player is attempting to collect in front of themselves until one player has accumulated all of their assigned game piece members.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. A method of playing a memory enhancing game employing a certain number of assigned game pieces having one visually distinguishable face and one blank face and twice the number of game pieces having two blank faces wherein the certain number of assigned game pieces are divided into equal groups wherein each group has a different visually distinguishable face on the assigned game pieces including the steps of:

(a) giving each player one of the groups of different visually distinguishable assigned game pieces and twice the number of blank game pieces;

(b) placing half of the blank game pieces and all of the assigned game pieces in a face down orientation and randomly rearranging the face down game pieces;

(c) placing equal numbers of the remaining blank game pieces in front of each player;

(d) selectively uncovering individual face down game pieces to match a given players group of assigned game pieces; and (e) replacing individual ones of the group of assigned game pieces of each player with one of the blank game pieces in front of that player.

2. A method of playing a memory enhancing game employing a certain number of assigned game piece members having a blank face and visually distinguishable face with twice the number of game pieces having blank faces including the steps of:

(a) placing all of the assigned game piece members and half of the blank game piece members in a face down orientation and equally dividing the remaining blank game piece members among the players;

(b) having each player in turn covertly expose the bottom face of a selected one of said face down game piece members.

3. The method as in claim 2 followed by the alternate steps of:

(c) removing said selected one of the game piece members that matched the players assigned game piece member, substituting a blank game piece member for said selected one of the game piece members, and making another selection; or, (d) replacing the selected one of the game piece members in its original position and letting the next player make their selection.

4. The method as in claim 3 including the steps of:

(e) repeating steps (a) through (d) until one of the players has replaced all of their assigned game piece members with blank game piece members.

* * * * *